US009038597B2

(12) United States Patent
Fukuoka

(10) Patent No.: US 9,038,597 B2
(45) Date of Patent: May 26, 2015

(54) ELECTRONIC THROTTLE CONTROL APPARATUS

(75) Inventor: Ryuichiro Fukuoka, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 503 days.

(21) Appl. No.: 13/071,037

(22) Filed: Mar. 24, 2011

(65) Prior Publication Data

US 2012/0090575 A1 Apr. 19, 2012

(30) Foreign Application Priority Data

Oct. 18, 2010 (JP) ..... 2010-233570

(51) Int. Cl.
*F02D 11/10* (2006.01)

(52) U.S. Cl.
CPC ..... *F02D 11/107* (2013.01); *F02D 2200/0404* (2013.01)

(58) Field of Classification Search
CPC ..... F02D 11/105; F02D 2200/0404; F02D 2200/501; F02D 41/222; B63H 20/00
USPC ..... 123/319, 339.19, 339.15, 352, 395, 123/399, 396; 701/29.1, 29.2, 29.7, 102, 701/107, 110, 114
See application file for complete search history.

(56) References Cited

U.S. PATENT DOCUMENTS

| | | | | |
|---|---|---|---|---|
| 5,720,258 | A * | 2/1998 | Tolkacz et al. | 123/352 |
| 6,032,644 | A * | 3/2000 | Bederna et al. | 123/339.15 |
| 6,647,959 | B2 * | 11/2003 | Noguchi | 123/396 |
| 7,677,937 | B2 * | 3/2010 | Ishida et al. | 440/1 |
| 8,160,790 | B2 * | 4/2012 | Oshima et al. | 701/62 |

FOREIGN PATENT DOCUMENTS

| | | | |
|---|---|---|---|
| JP | 01-198296 | A | 8/1989 |
| JP | 05-254326 | A | 10/1993 |
| JP | 11-241638 | A | 9/1999 |
| JP | 2006-194164 | A | 7/2006 |
| JP | 2009-057982 | A | 3/2009 |

* cited by examiner

*Primary Examiner* — Hai Huynh
*Assistant Examiner* — Gonzalo Laguarda
(74) *Attorney, Agent, or Firm* — Sughrue Mion, PLLC

(57) ABSTRACT

An electronic throttle control apparatus has a construction which does not use a mechanical mechanism to restrict an operating angle of an electronic throttle valve, and continues motor control so as to prevent rapid opening and closing of the electronic throttle valve, even if an angle detection unit becomes abnormal. Upon detection of an abnormality, a control unit (1) controls, without using pieces of angle information (θ1, θ2) after the detection of the abnormality, a motor (2) for driving the electronic throttle valve (3) based on angle information (θb) before the angle detection unit (6) becomes abnormal, information of electric power supplied to the motor (2) before the angle detection unit (6) becomes abnormal, a period of time (Tbc) until the abnormality of the angle detection unit (6) is detected, and a preset rate of change of a throttle angle.

7 Claims, 10 Drawing Sheets

ELECTRONIC THROTTLE CONTROL APPARATUS

BACKGROUND OF THE INVENTION

1. Field of the Invention

The present invention relates to an electronic throttle control apparatus for controlling an electronic throttle valve which serves to adjust an amount of intake air in an internal combustion engine, and more particularly, it relates to an electronic throttle control apparatus which is able to cope with the time of abnormality of an electronic throttle valve angle detection sensor (hereinafter referred to simply as an "angle sensor") which serves to detect an angle of the electronic throttle valve.

2. Description of the Related Art

In general, in an internal combustion engine mounted on a vehicle, etc., there has been used, as a throttle valve for adjusting an amount of intake air, an electronic throttle valve which is mechanically connected with an accelerator pedal which is operated by a driver, and there have been proposed a variety of kinds of electronic throttle control apparatuses for carrying out feedback control of an electronic throttle valve in accordance with detection information on the throttle angle of the throttle valve.

In this kind of electronic throttle control apparatus, it is constructed such that when a system abnormality such as a failure of an angle sensor has occurred, in order to ensure safety of the vehicle, the supply of electric power to a motor for driving the electronic throttle valve is interrupted so as to prevent the rotational speed of the internal combustion engine from being raised in an abrupt manner, and the electronic throttle valve is induced or guided to a predetermined intermediate degree of opening by means of an induction or guidance mechanism which functions at the time of abnormality.

However, in cases where a system abnormality has occurred in an open position of the electronic throttle valve, the electronic throttle valve is closed toward the intermediate degree of opening by means of the induction mechanism although the supply of electric power to the motor for driving the electronic throttle valve (hereinafter referred to simply as a "motor") is interrupted, so the engine rotational speed of the internal combustion engine decreases in a rapid manner. As a result, a sudden deceleration of the vehicle may be caused, and in particular, in vehicles of light weight such as a two-wheeled motor vehicle, a sudden deceleration condition may result.

Accordingly, in recent years, there is also proposed an electronic throttle valve control apparatus in which in cases where a system abnormality has occurred, by putting the motor into a regenerative state, the speed at which the electronic throttle valve moves to the intermediate degree of opening is suppressed by means of the induction mechanism, so that a rapid decrease in the rotational speed of the internal combustion engine is thereby prevented (for example, see a first patent document).

However, in an electronic throttle valve control apparatus described in the first patent document, too, it is not possible to prevent a change in the actual angle of the electronic throttle valve (hereinafter referred to as the "actual throttle angle") which is generated by the motor being controlled by the time when a system abnormality is detected.

In addition, a means for putting the motor into a regenerative state after a system abnormality is detected serves to hold the change of the actual throttle angle which has been generated by the time when the system abnormality is detected, so a sudden deceleration or sudden acceleration of the vehicle can be caused.

For example, in cases where the angle sensor becomes abnormal, in a period of time until the abnormality is detected, the motor is controlled by the use of angle information which is different from the actual throttle angle.

As a result, a sudden deceleration or a sudden acceleration of the vehicle will be caused due to the change of the actual throttle angle generated by the control of the motor until the time when the abnormality is detected, as well as the holding of an angular difference between a target throttle opening (target opening) and the actual throttle angle at the time of putting the motor into the regenerative state after the detection of abnormality.

As a measure against the above-mentioned sudden acceleration and deceleration, there has also been proposed a technique in which in order to suppress a change in an actual throttle angle generated by the time when a system abnormality is detected, a mechanical mechanism is provided which is connected with an accelerator pedal adapted to be operated by a driver, so that the degree of operating angle of an electronic throttle valve is restricted.

However, in cases where the mechanical mechanism connected with the accelerator pedal so as to restrict the degree of operating angle of the electronic throttle valve is used, even if the system of an electronic throttle control apparatus is in a normal state, the electronic throttle valve can not be controlled beyond the degree of operating angle thereof, because the degree of operating angle of the electronic throttle valve is restricted.

In addition, in the electronic throttle valve which has a restriction on the degree of operating angle thereof, there is also the problem that in cases where the driver abruptly operates the accelerator pedal to its closed side, the electronic throttle valve is closed in an abrupt manner, irrespective of the operating state of the internal combustion engine.

In this case, because the intake air to the internal combustion engine is interrupted or cut off rapidly, the fuel adhered to an intake manifold does not often burn, thus leading to the degradation of a three-way catalyst which is arranged in an exhaust system, as well as the deterioration of exhaust gas.

On the other hand, as stated above, in the case of adopting an electronic throttle valve which is not provided with a restriction mechanism mechanically connected with an accelerator pedal adapted to be operated by a driver, it becomes possible to carry out optimal fuel injection based on the condition of the accelerator pedal operated by the driver and the operating state of the internal combustion engine.

As described above, the suppression of the change of the actual throttle angle generated by the time when a system abnormality in the electronic throttle valve control apparatus is detected, and the abolition of the mechanical mechanism for restricting the degree of operating angle of the electronic throttle valve have a relation of trade-off, and hence, it is difficult to solve both of these problems at the same time.

PRIOR ART REFERENCES

Patent Documents

First Patent Document: Japanese patent No. 4212059

SUMMARY OF THE INVENTION

Conventional electronic throttle control apparatuses have a problem that in cases where an induction or guidance mechanism, which puts a motor into a regenerative state, is used so as to suppress an abrupt decrease in the rotational speed of an internal combustion engine at the time of a system abnormality, it is impossible to prevent the change of the actual throttle angle generated by the time when the abnormality is detected, and besides, the change of the actual throttle angle by the time when the abnormality is detected is held, so there is a possibility that an abrupt deceleration or an abrupt acceleration of a vehicle may be caused.

In addition, in cases where a mechanical suppression mechanism connected with an accelerator pedal is used so as to suppress the change of the actual throttle angle thereby to avoid an abrupt acceleration and an abrupt deceleration, there has been a problem that an electronic throttle valve can not be controlled beyond or more than a restricted degree of operating angle even if the system is in a normal condition, and besides, in cases where the accelerator pedal is operated to be closed in an abrupt manner, degradation of a three-way catalyst and deterioration of exhaust gas may be caused by the incomplete combustion of fuel due to the abrupt closure of the electronic throttle valve.

This invention has been made in order to solve the problems as referred to above, and has for its object to obtain an electronic throttle control apparatus which is not provided with a restriction mechanism mechanically connected with an accelerator pedal, and which is capable of preventing rapid opening and closing of an electronic throttle valve by continuing control thereof by means of motor drive even if an angle detection unit (angle sensor) becomes abnormal.

An electronic control apparatus according to this invention is provided with a motor that drives an electronic throttle valve for adjusting an amount of intake air in an internal combustion engine, an angle detection unit that detects an angle of the electronic throttle valve, an electric power supply unit that supplies electric power to the motor, and a control unit that generates an electric power supply command to the motor based on angle information detected by the angle detection unit, and supplies electric power to the motor through the electric power supply unit, wherein the control unit generates, after detection of an abnormality of the angle detection unit, the electric power supply command to the motor based on the angle information before the detection of the abnormality of the angle detection unit.

According to this invention, it is possible to prevent rapid opening and closing of the electronic throttle valve at the time of a system abnormality by carrying out the supply of electric power to the motor in accordance with the failure state of the angle detection unit.

BEST MODES FOR CARRYING OUT THE INVENTION

First Embodiment

Figure 1:
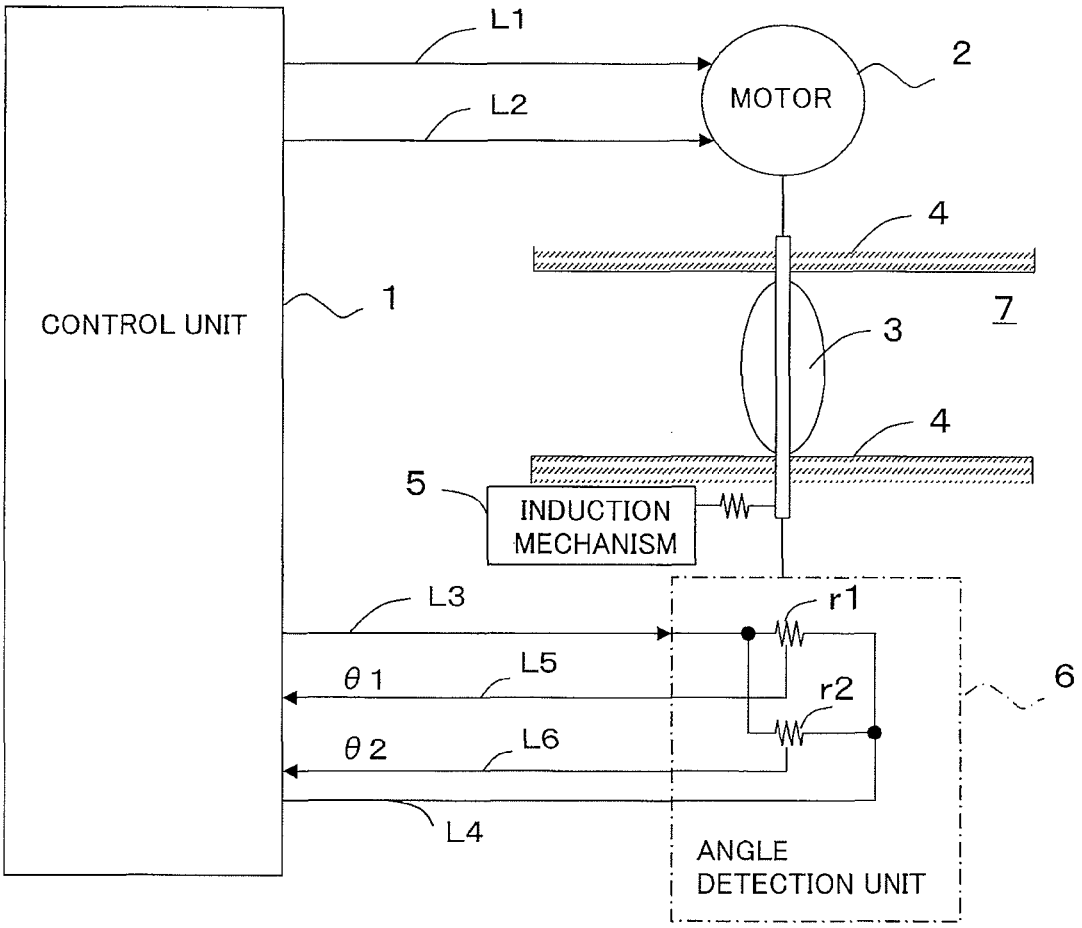
FIG. 1 is a block diagram showing the overall construction of a motor control part of an electronic throttle control apparatus according to a first embodiment of the present invention.

FIG. 1 is a block diagram showing the overall construction of a motor control part of an electronic throttle control apparatus according to a first embodiment of the present invention.

Figure 2:
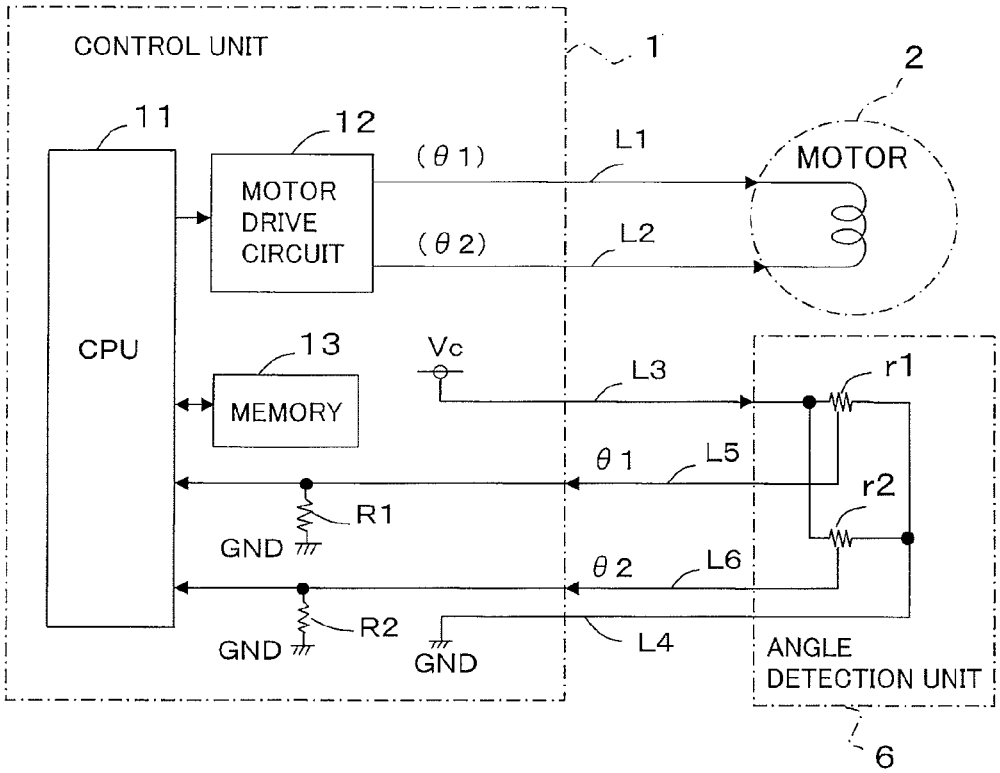
FIG. 2 is a block diagram showing the internal construction of a control unit in FIG. 1.

FIG. 2 is a block diagram showing the internal construction of a control unit 1 in FIG. 1, wherein an electronic throttle valve 3 and its surrounding construction are omitted for the sake of avoiding complications.

In FIG. 1 and FIG. 2, the electronic throttle control apparatus is provided with a control unit 1, a motor 2 to which electric power is supplied from the control unit 1 through wires L1, L2 for the supply of electric power, an electronic throttle valve 3 that is driven to operate by means of the motor 2, a throttle body 4 that serves to hold the electronic throttle valve 3 in an intake passage 7, an induction or guidance mechanism 5 that serves to induce or guide the electronic throttle valve 3 to a predetermined intermediate degree of opening θM at the time of abnormality, and an angle detection unit 6 (angle sensor) to which electric power is supplied from the control unit 1 through a power line L3 and a ground line L4.

The electronic throttle valve 3 is arranged in the throttle body 4, and is mechanically connected with the motor 2 (and the induction mechanism 5), so that it adjusts an amount of intake air in an internal combustion engine (not shown).

The angle detection unit 6 serves to detect an angle (i.e., a degree of opening) of the electronic throttle valve 3, and input two pieces of angle information θ1, θ2 to the control unit 1 through signal lines L5, L6, respectively.

Here, note that the angle detection unit 6 has internal variable resistances r1, r2, of a parallel arrangement for the purpose of improving reliability, wherein it generates two pieces of angle information θ1, θ2 from individual variable output terminals of the internal variable resistances r1, r2, respectively, and inputs them to the control unit 1.

The control unit 1 detects a degree of opening (i.e., a throttle angle) of the electronic throttle valve 3 based on the two pieces of angle information θ1, θ2 from the angle detection unit 6, and generates an electric power supply command to the motor 2 based on the throttle angle thus detected, whereby the amount of electric power supplied to the motor 2 through the electric power supply wires L1, L2 is controlled so as to adjust the electronic throttle valve 3 in such a manner that an actual throttle angle θr is made equal to a required target opening θo.

In FIG. 2 the control unit 1 is provided with a CPU 11, a motor drive circuit 12 for driving the motor 2 under the control of the CPU 11, a memory 13 belonging to the CPU 11, a pair of input resistors R1, R2 for inputting the two pieces of angle information θ1, θ2 to the CPU 11, a power supply Vc that is connected to the power line L3 for the supply of electric power to the angle detection unit 6, and a ground GND that is connected to the ground line L4 and at the same time serves to ground individual one ends of the input resistors R1, R2.

The signal lines L5, L6, which take in the two pieces of angle information θ1, θ2, respectively, are connected to the ground GND through the input resistors R1, R2 in parallel to an input path to the CPU 11 in the control unit 1, so as to detect, as an abnormality of the angle detection unit 6, an open circuit such as a break, disconnection or the like in the power line L3, the ground line L4, the signal lines L5, L6, etc.

Here, note that in order to ensure the input levels of the input resistors R1, R2, the resistance values of the input resistors R1, R2 are set to values sufficiently larger than the resistance values of the internal variable resistances r1, r2 inside the angle detection unit 6, respectively.

The motor drive circuit 12 supplies electric power to the motor 2 through the electric power supply wires L1, L2 in accordance with the electric power supply command from the CPU 11, so that it controls the electronic throttle valve 3 to the desired target opening θo.

Next, the behavior of the speed Vs of a vehicle in cases where a system abnormality has occurred in the electronic throttle control apparatus of FIG. 1 and FIG. 2 will be explained with reference to FIG. 5 and FIG. 6, together with FIG. 3 and FIG. 4.

Here, in order to clarify the operational effect of motor control according to the first embodiment of the present invention, the explanation will be made while making a comparison between the behavior of the speed of a vehicle according to conventional motor control (FIG. 3) and the behavior of the speed of a vehicle according to the motor control of the first embodiment of the present invention (FIG. 4), with the assumption that FIG. 1 and FIG. 2 show a common construction for both motor control.

Figure 3:
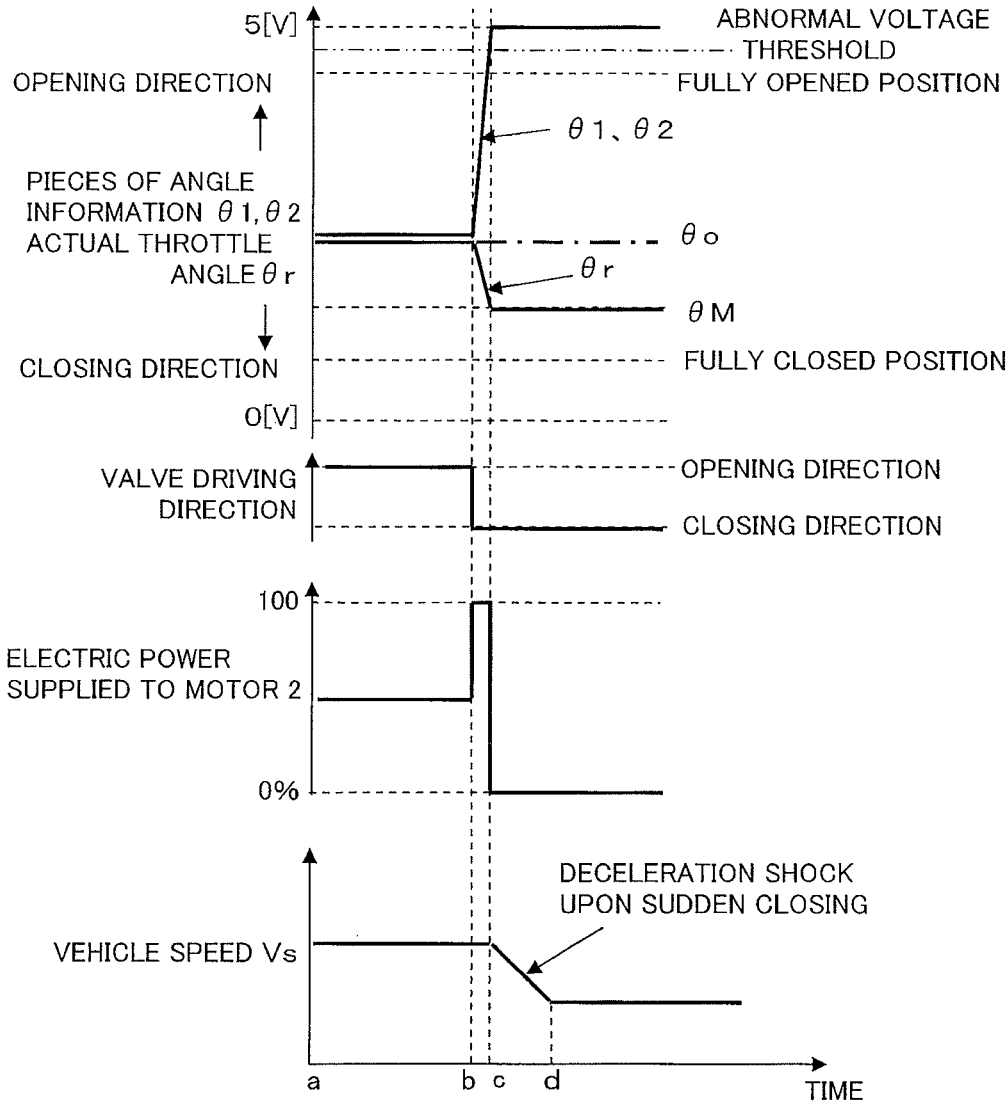
FIG. 3 is a timing chart showing the behavior of the speed of a vehicle at the time of a system abnormality in a conventional electronic throttle control apparatus.

FIG. 3 is a timing chart which shows the behavior of the speed Vs of a vehicle according to the conventional motor control, wherein the pieces of angle information θ1. θ2, the valve driving direction of the motor 2, the electric power supplied from the control unit 1 to the motor 2, and the vehicle speed Vs in cases where a disconnection abnormality has occurred in the ground line L4 in FIG. 2 at the timing of time point b are illustrated in a time series manner.

In FIG. 3 (the conventional control), in an interval from time point a to time point b, the ground line L4 in FIG. 2 is in a normal state (i.e., is not disconnected), wherein the target opening θo from the CPU 11, the pieces of angle information θ1, θ2, and the actual throttle angle θr are in coincidence with one another.

That is, in the above-mentioned interval, with respect to the intermediate degree of opening θM by the induction mechanism 5, the target opening θo is at an open side, so the valve driving direction by the motor 2 is a valve opening direction, and the motor drive circuit 12 in the control unit 1 supplies required electric power to the motor 2 so as to make the pieces of angle information θ1, θ2 coincide with the target opening θo from the CPU 11.

Accordingly, in the above-mentioned interval, the target opening θo from the CPU 11 and the pieces of angle information θ1, θ2 are in coincidence with each other, and the vehicle speed Vs is constant.

Subsequently, when the ground line L4 is disconnected or open circuited at the time point b, the pieces of angle information θ1, θ2 to the control unit 1 changes into a fully opened direction (toward a 5 [V] side) due to the disconnection or open circuit of the ground line L4, and hence, in order to suppress this, the control unit 1 changes the valve driving direction into a valve closing direction, and carries out feedback control of the motor 2 with the 100% amount of supply power.

Thereafter, in an interval from time point b to time point c, the actual throttle angle θr changes into the valve closing direction, and in contrast to this, the pieces of angle information θ1, θ2 from the angle detection unit 6 continue to change in the fully opened direction, but the pieces of angle information θ1, θ2 do not reach equal to or higher than an abnormal voltage threshold in the valve opening direction, so the CPU 11 can not detect an abnormal state (i.e., disconnection or open circuit of the ground line L4).

Therefore, in the above-mentioned interval from the time point b (i.e., the occurrence of disconnection of the ground line L4) to the time point c, the CPU 11 continues to carry out the 100% supply of electric power in the valve closing driving direction based on the pieces of angle information θ1, θ2, so the actual throttle angle θr is rapidly driven to the closed side.

As a result, the vehicle speed Vs begins to drop down in a rapid manner from the time point c which is slightly later than the time point b.

Hereinafter, when the pieces of angle information θ1, θ2 reach equal to or higher than the abnormal voltage threshold in the valve opening direction at the time point c, the CPU 11 detects the abnormality of the pieces of angle information θ1, θ2 (disconnection or open circuit of the ground line L4), and after the detection of the abnormality (time point c), the actual throttle angle θr becomes unknown, so the supply of electric power from the control unit 1 to the motor 2 is made into 0%.

When the supply of electric power to the motor 2 is interrupted, the actual throttle angle θr is induced or guided to the intermediate degree of opening θM by means of the induction mechanism 5, so the vehicle speed Vs rapidly decreases over a time interval or period from the time point c to time point d which is slightly later than the time point c. In particular, in a vehicle of light weight such as an automatic two-wheeled vehicle, the rapidly decreasing tendency of the vehicle speed Vs becomes strong, thus giving a large deceleration shock to the driver.

Figure 4:
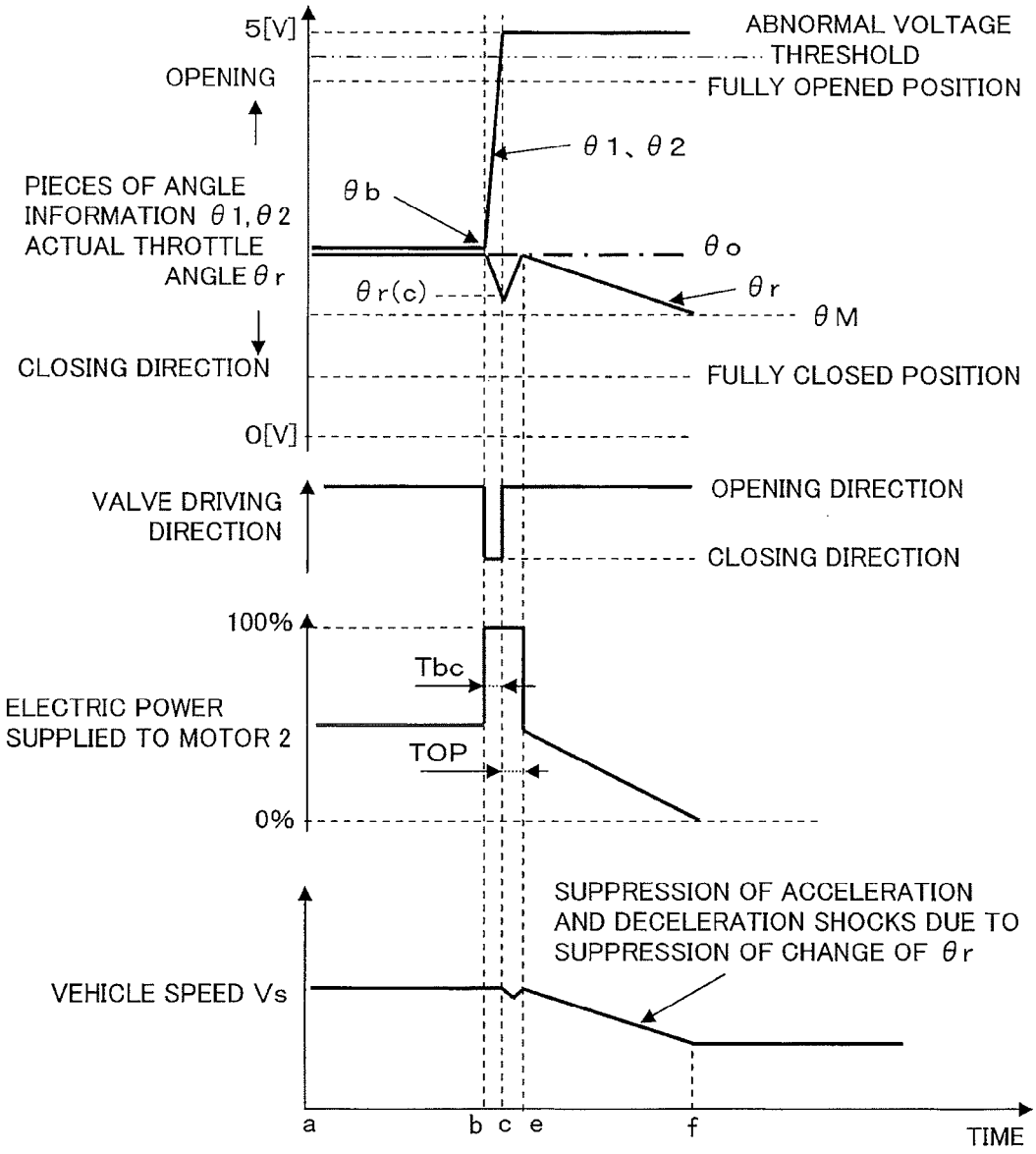
FIG. 4 is a timing chart showing the behavior of the speed of a vehicle at the time of a system abnormality in the first embodiment of the present invention.

On the other hand, according to the first embodiment of the present invention shown in FIG. 4, it becomes possible to suppress the deceleration shock as shown in FIG. 3.

FIG. 4 is a timing chart which shows the behavior of the vehicle speed Vs according to the first embodiment (FIG. 1 and FIG. 2) of the present invention, wherein similar to FIG. 3, the pieces of angle information θ1, θ2, the valve driving direction of the motor 2, the electric power supplied from the control unit 1 to the motor 2, and the vehicle speed Vs in cases where a break or disconnection has occurred in the ground line L4 in FIG. 2 at the timing of time point b are illustrated in a time series manner.

In FIG. 4, in the interval from the time point a to the time point b, the ground line L4 is not disconnected, similarly as mentioned above (FIG. 3), so the motor drive circuit 12 in the control unit 1 supplies electric power to the motor 2 so as to make the pieces of angle information θ1, θ2 coincident with the target opening θo, as a result of which the target opening θo and the pieces of angle information θ1, θ2 (the actual throttle angle θr) are coincident with each other, and hence the vehicle speed Vs is constant.

However, the control unit 1 according to the first embodiment of the present invention operates to store, in the normal interval from the time point a to the time point b, the target opening θo from the CPU 11, the pieces of angle information θ1, θ2 from the angle detection unit 6, the valve driving direction of the motor 2, and the value of electric power supplied to the motor 2, into the memory 13 in a time series manner, in preparation for the case where the ground line L4 is disconnected.

Similarly as stated above (FIG. 3), when the ground line L4 is disconnected at the time point b, the pieces of angle information θ1, θ2 change in the fully opened direction (5 [V] side) in the interval from the time point b to the time point c, so the actual throttle angle θr changes in the closed direction under the feedback control of the control unit 1.

Because in the above-mentioned interval, the pieces of angle information θ1, θ2 have not yet reached equal to or higher than the abnormal voltage threshold in the valve opening direction, the CPU 11 is not able to detect abnormality, and carries out a 100% supply of electric power in the valve closing driving direction based on the pieces of angle information θ1, θ2, so the actual throttle angle θr is rapidly driven to the closed side.

As a result, the vehicle speed Vs begins to decrease from the time point c which is slightly later than the time point b.

On the other hand, at the time point c, the pieces of angle information θ1, θ2 reach equal to or higher than the abnormal voltage threshold in the valve opening direction, so the CPU 11 detects the abnormality of the pieces of angle information θ1, θ2 (disconnection or open circuit of the ground line L4), and estimates the actual throttle angle θr(c) at the time point c, according to the following equation (1).

$$\theta r(c)=\theta b-\Delta\theta CL\times Tbc \quad (1)$$

Here, note that in equation (1) above, θb is the pieces of angle information (θ1, θ2) at the time point b, Tbc is a period of time from the time point b to the time point c, and ΔθCL is an amount of change at the closed side per unit time of the pieces of angle information θ1, θ2 at the time of the 100% supply of electric power (the rate of change in the closing direction).

The period of time Tbc from the time point b to the time point c can be uniquely calculated with the use of the resistance values of the internal variable resistances r1, r2 inside the angle detection unit 6, and the resistance values of the input resistors R1, R2 inside the control unit 1.

In addition, the piece of angle information θb at the time point b can be calculated with the use of the pieces of angle information θ1, θ2 stored in the memory 13 inside the control unit 1 in a time series manner, and the period of time Tbc from the time point b to the time point c.

Figure 5:
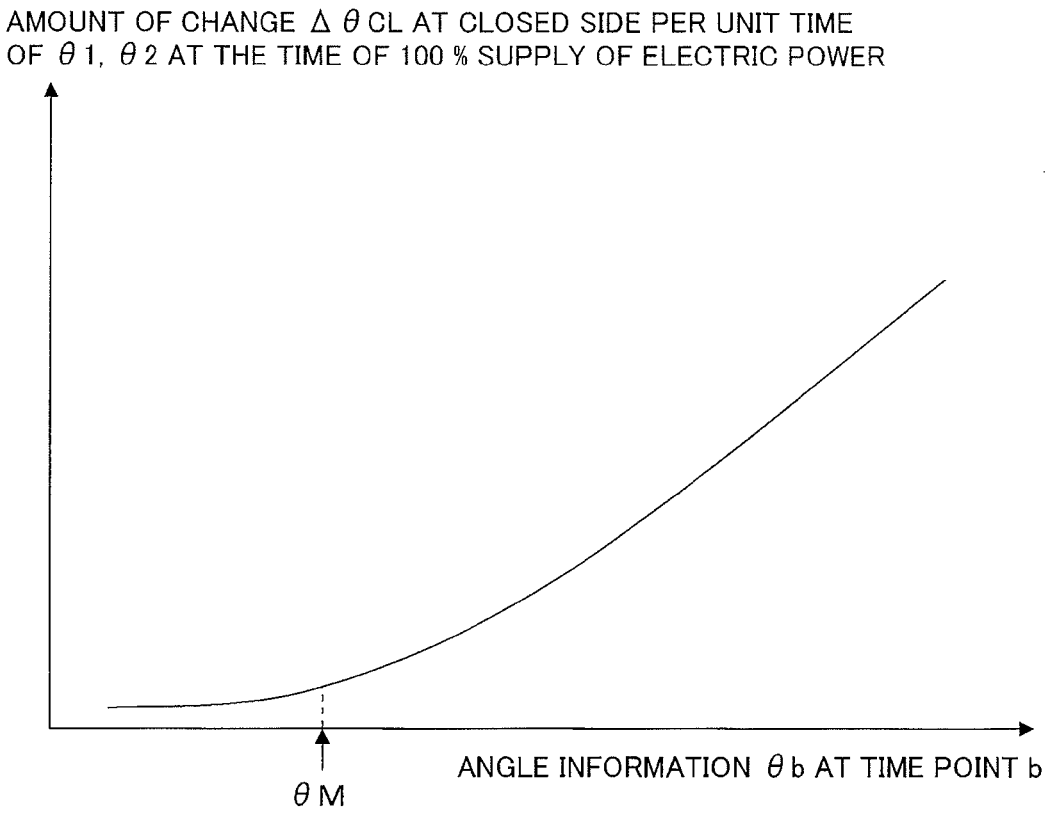
FIG. 5 is an explanatory view showing an amount of change per unit time of angle information at a closing side at the time of a 100% supply of electric power according to the first embodiment of the present invention.

FIG. 5 is an explanatory view which shows the amount of change ΔθCL at the closed side per unit time of the pieces of angle information θ1, θ2 at the time of the 100% supply of electric power.

As shown in FIG. 5, the amount of change ΔθCL at the closed side can be experimentally obtained based on the relation between the piece of angle information θb at the time point b and the intermediate degree of opening θM, by taking into consideration of the influence of the induction mechanism 5 which serves to induce or guide the electronic throttle valve 3 to the intermediate degree of opening θM.

Then, returning to FIG. 4, the CPU 11 estimates the actual throttle angle θr(c) at the time point c from the equation (1), and performs control for making the throttle angle θr(c) (estimated value) at the time point c coincident with the piece of angle information θb at the time point b (the degree of opening at the time of normal operation before the occurrence of abnormality).

That is, at the time point c, the CPU 11 changes the valve driving direction to the valve opening direction while ignoring the pieces of angle information θ1, θ2, and at the same time calculates an electric power supply time TOP to the motor 2 for driving the electronic throttle valve 3 with the 100% amount of power supply, according to the following equation (2).

$$TOP=\{\theta b-\theta r(c)\}/\Delta\theta OP \quad (2)$$

Figure 6:
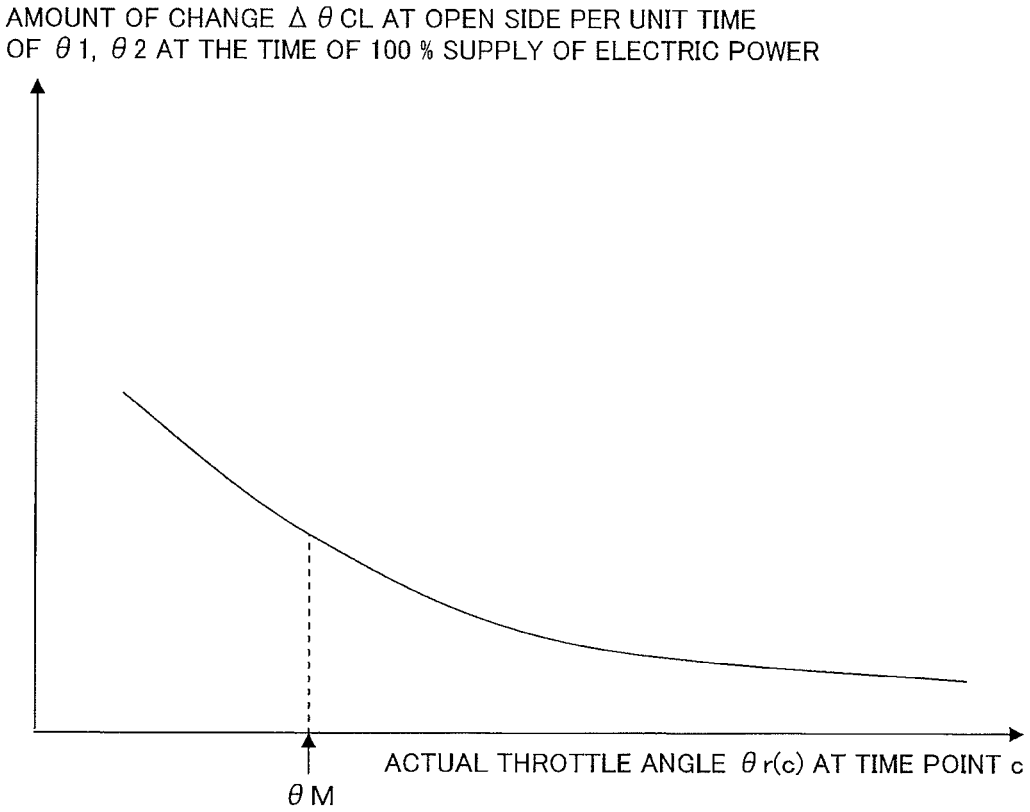
FIG. 6 is an explanatory view showing an amount of change per unit time of angle information at an opening side at the time of a 100% supply of electric power according to the first embodiment of the present invention.

Here, note that in equation (2) above, ΔθOP is an amount of change at the open side per unit time of the pieces of angle information θ1, θ2 at the time of the 100% supply of electric power (the rate of change in the opening direction), and is represented as shown in an explanatory view of FIG. 6.

As shown in FIG. 6, the amount of change ΔθOP at the open side can be experimentally obtained based on the relation between the actual throttle angle θr(c) at the time point c and the intermediate degree of opening θM, in consideration of the influence of the induction mechanism 5.

According to this, the control unit 1 can return the actual throttle angle θr to the piece of angle information θb at the time point b in a quick manner by energizing the motor 2 with the 100% amount of power supply in the valve opening driving direction over the electric power supply time TOP from the time point c to time point e.

As a result, an abrupt decrease of the vehicle speed Vs is suppressed, and at the time point e, the vehicle speed Vs returns to the speed at the time of normal operation (at the time point b).

Here, note that in an interval from the time point b to the time point e, the actual throttle angle θr changes between the target opening θo and the actual throttle angle θr(c) at the time point c, but if the period of time of the change at this time is a short time, as shown in FIG. 4, a decrease in the vehicle speed Vs will hardly be generated.

Subsequently, in an interval from the time point e to time point f, in order to make the vehicle travel at a safe speed, the CPU 11 drives the motor 2 in such a manner that the actual throttle angle θr goes to the intermediate degree of opening θM gradually at a constant rate, so as not to cause a rapid change of the actual throttle angle θr.

At this time, the amount of power supply to the motor 2 at the time point e uses the value of electric power supplied to the motor 2 (the amount of power supply before the occurrence of abnormality) stored in the memory 13 inside the control unit 1 in a time series manner, and is made to decrease at a constant rate from the time point e to the time point f.

As a result of this, the actual throttle angle θr can be driven to the intermediate degree of opening θM in such a manner as not to cause a rapid change.

As described above, the electronic throttle control apparatus according to the first embodiment (FIG. 1, FIG. 2, and FIG. 4 through FIG. 6) of the present invention is provided with the motor 2 that drives the electronic throttle valve 3 for adjusting the amount of intake air sucked into the internal combustion engine, the angle detection unit 6 that detects the angle of the electronic throttle valve 3, an electric power supply unit (the motor drive circuit 12, the electric power supply wires L1, L2) that supplies electric power to the motor 2, and the control unit 1 that generates an electric power supply command to the motor 2 based on the pieces of angle information θ1, θ2 detected by the angle detection unit 6, and supplies electric power to the motor 2 through the electric power supply unit.

The control unit 1 generates, after the detection of the abnormality of the angle detection unit 6 (the brake or disconnection of the ground line L4), the electric power supply command to the motor 2 based on the piece of angle information (θb) before the detection of the abnormality of the angle detection unit 6 (at the time point b).

Specifically, the control unit 1 estimates, after the detection of the abnormality of the angle detection unit 6, the actual throttle angle (θr(c)) immediately after the detection of the abnormality of the angle detection unit 6 (at the time point c) from the piece of angle information (θb) before the detection of the abnormality of the angle detection unit 6, and generates the electric power supply command to the motor 2 so that the actual throttle angle θr of the electronic throttle valve 3 is coincident with the piece of angle information (θb) before the occurrence of the abnormality of the angle detection unit 6.

In addition, after the detection of the abnormality of the angle detection unit 6, the control unit 1 performs the supply of electric power to the motor 2 by means of the combination of a plurality of control operations, so that the actual throttle angle θr of the electronic throttle valve 3 is controlled to the intermediate degree of opening θM.

Specifically, the plurality of control operations include an operation which makes the actual throttle angle θr(c) (the estimated value) of the electronic throttle valve 3 coincident with the piece of angle information (θb) before the occurrence of abnormality, by performing the 100% amount of power supply to the motor 2 after the detection of the abnormality of the angle detection unit 6, and an operation which makes the actual throttle angle θr of the electronic throttle valve 3 move to the intermediate degree of opening θM, by returning, after the actual throttle angle θr becomes coincident with the piece of angle information (θb) before the occurrence of the abnormality, the amount of electric power supplied to the motor 2 to the amount of power supply before the occurrence of the abnormality, and making it decrease at a fixed rate.

Further, in the operation which makes, after the detection of the abnormality of the angle detection unit 6, the actual throttle angle θr of the electronic throttle valve 3 coincident with the piece of angle information θb before the occurrence of the abnormality, the control unit 1 prohibits the use of the pieces of angle information θ1, θ2 after the detection of the abnormality, and controls the motor 2 based on the piece of angle information θb before the angle detection unit 6 becomes abnormal, the information of electric power supplied to the motor 2 during feedback control before the angle detection unit 6 becomes abnormal, the period of time (Tbc) until the abnormality of the angle detection unit 6 is detected, and the rates of change (ΔθCL, ΔθOP) of the throttle angle which have been preset before the angle detection unit 6 becomes abnormal.

As a result of this, even at the time of the disconnection abnormality of the ground line L4 (FIG. 4), it is possible to prevent the sudden deceleration or sudden acceleration of the vehicle, whereby it is possible to provide safe travel to the driver without causing rapid acceleration or rapid deceleration, while not spoiling the controllability of the electronic throttle valve 3.

Second Embodiment

Figure 8:
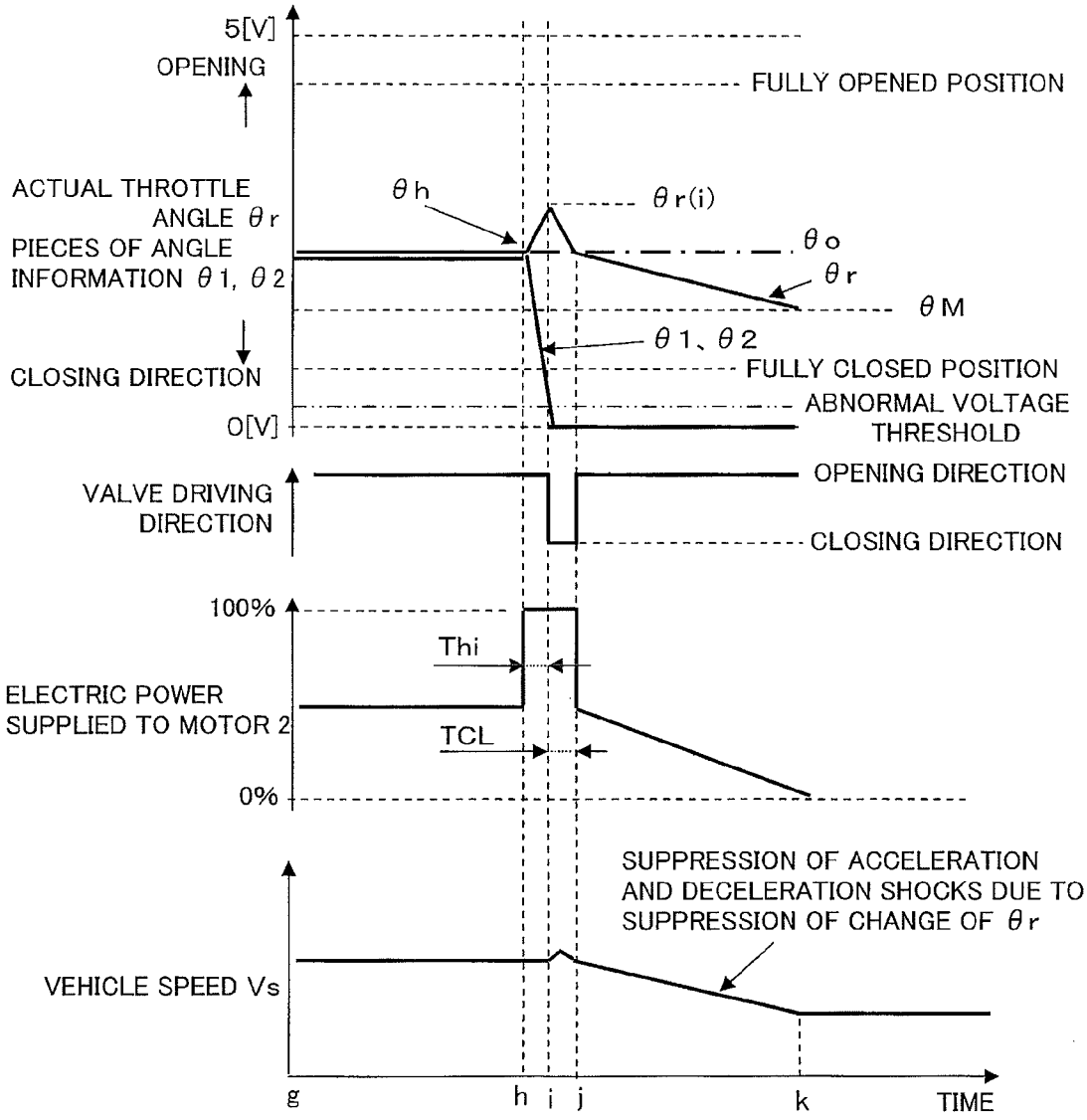
FIG. 8 is a timing chart showing the behavior of the speed of a vehicle at the time of a system abnormality in a second embodiment of the present invention.
Figure 9:
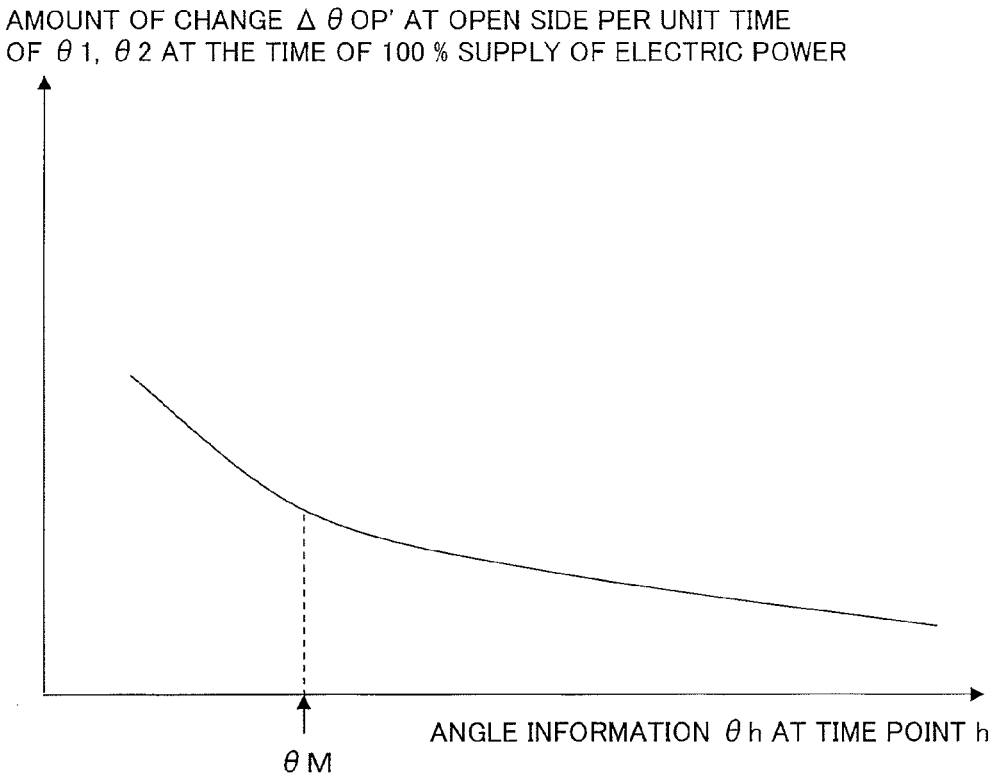
FIG. 9 is an explanatory view showing an amount of change per unit time of angle information at an opening side at the time of a 100% supply of electric power according to the second embodiment of the present invention.
Figure 10:
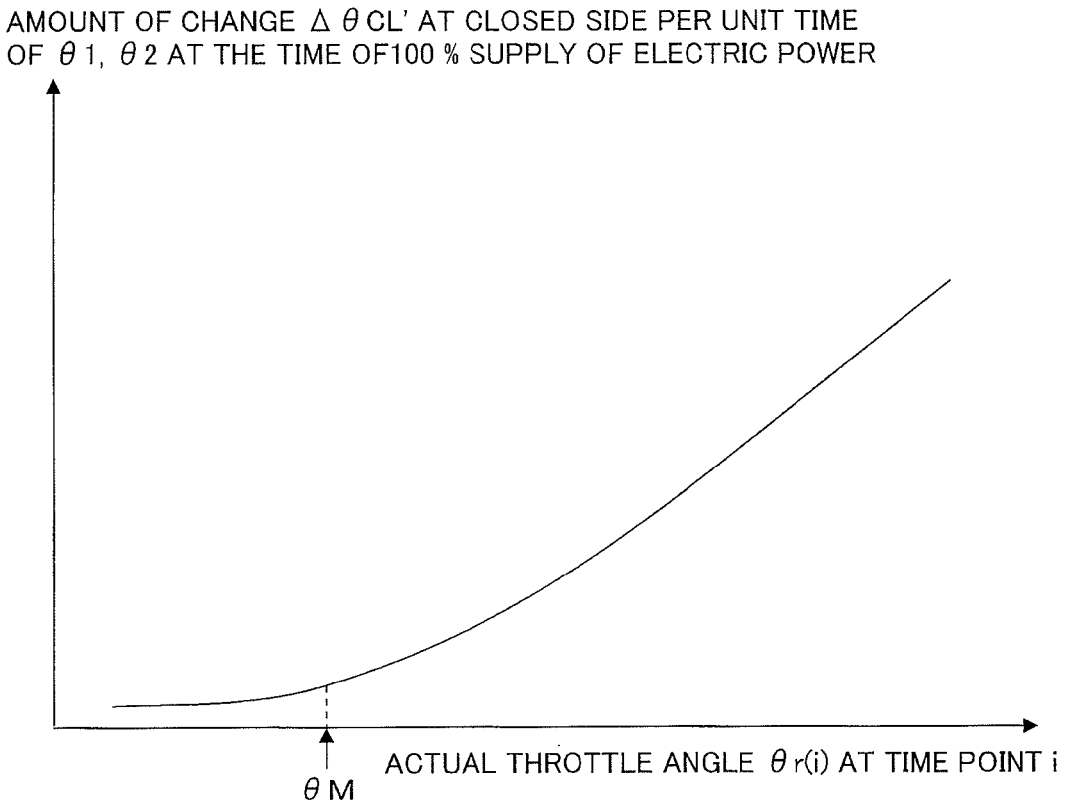
FIG. 10 is an explanatory view showing an amount of change per unit time of angle information at a closing side at the time of a 100% supply of electric power according to the second embodiment of the present invention.

Although the above-mentioned first embodiment (FIG. 1, FIG. 2, and FIG. 4 through FIG. 6), reference has been made to the suppression control of acceleration and deceleration shocks in cases where the ground line L4 is broken or disconnected, it is also possible to achieve the suppression control of acceleration and deceleration shocks in cases where the power line L3 is broken or disconnected, as shown in FIG. 8 through FIG. 10.

In the following, reference will be made to the behavior of the vehicle speed Vs in cases where a system abnormality has occurred in a second embodiment of the present invention, while referring to FIG. 7 through FIG. 10, together with FIG. 1 and FIG. 2.

Here, note that the construction of an electronic throttle control apparatus according to the second embodiment of the present invention is as shown in FIG. 1 and FIG. 2.

In this case, too, in order to clarify the operational effect of motor control according to the second embodiment of the present invention, the explanation will be made while making a comparison between the behavior of the speed of a vehicle according to conventional motor control (FIG. 7) and the behavior of the speed of a vehicle according to the motor control of the second embodiment of the present invention (FIG. 8).

Figure 7:
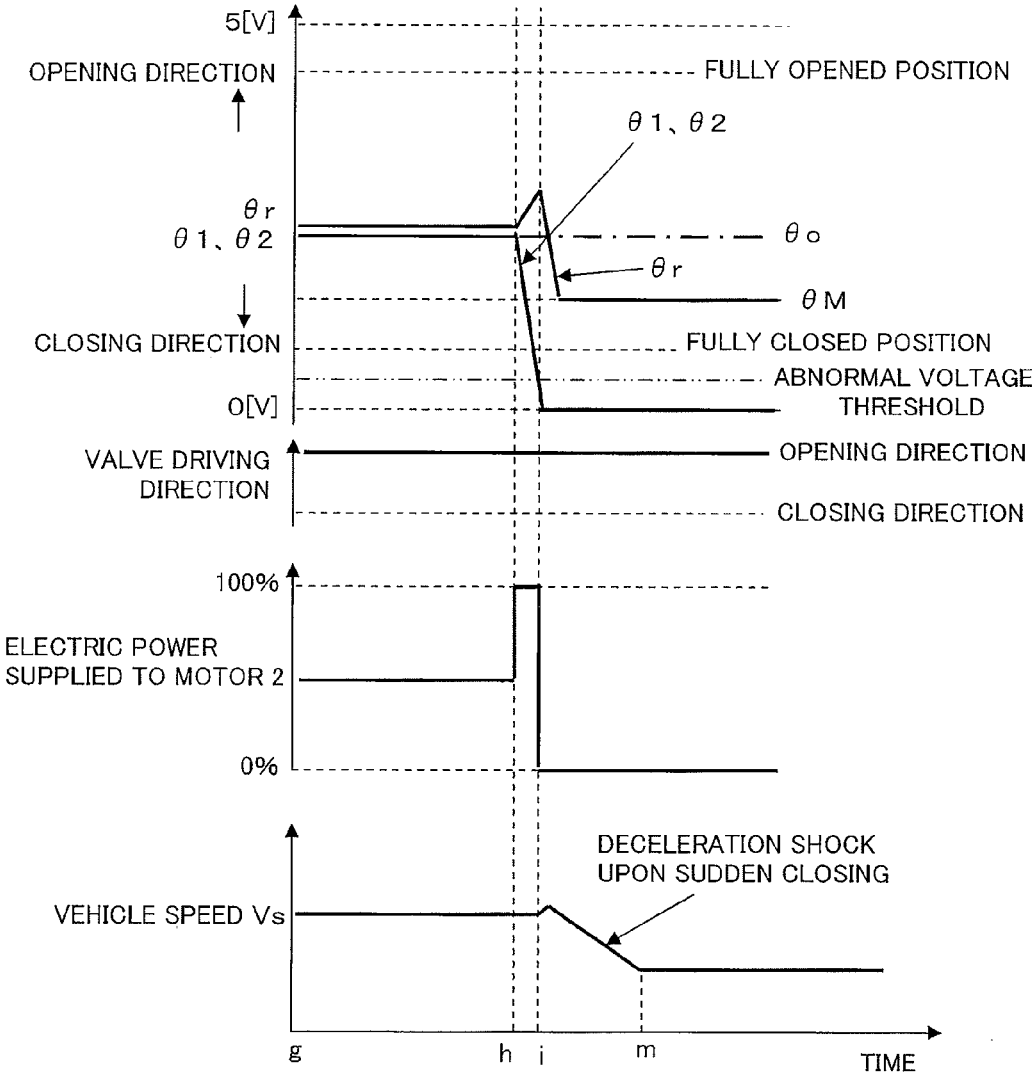
FIG. 7 is a timing chart showing the behavior of the speed of a vehicle at the time of a system abnormality in a conventional electronic throttle control apparatus.

FIG. 7 is a timing chart showing the behavior of the speed Vs of a vehicle at the time of a system abnormality in a conventional electronic throttle control apparatus, and FIG. 8 is a timing chart showing the behavior of the speed Vs of a vehicle at the time of a system abnormality in the second embodiment of the present invention.

In addition, FIG. 9 is an explanatory view showing an amount of change per unit time ΔθOP' of the pieces of angle information θ1, θ2 at an opening side at the time of the 100% supply of electric power according to the second embodiment of the present invention, and FIG. 10 is an explanatory view showing an amount of change per unit time ΔθCL' of the pieces of angle information θ1, θ2 at a closing side at the time of the 100% supply of electric power according to the second embodiment of the present invention.

In FIG. 7 and FIG. 8, the pieces of angle information θ1, θ2, the valve driving direction of the motor 2, the electric power supplied from the control unit 1 to the motor 2, and the vehicle speed Vs in cases where a break or disconnection has occurred in the power line L3 at time point h are illustrated in a time series manner.

In FIG. 7 (the conventional control), in an interval from time point g to time point h, the power line L3 in FIG. 2 is in a normal state, wherein the target opening θo from the CPU 11, the pieces of angle information θ1, θ2 from the angle detection unit 6, and the actual throttle angle θr are in coincidence with one another, and the vehicle speed Vs is constant.

Subsequently, when the power line L3 is disconnected or open circuited at the time point h, the pieces of angle information θ1, θ2 changes into the fully opened direction (toward a 0 [V] side), and hence, in order to suppress this, the control unit 1 keeps the valve driving direction in the valve opening direction, and carries out feedback control of the motor 2 with the 100% amount of supply power.

Thereafter, in an interval from time point h to time point i, the actual throttle angle θr changes into the valve opening direction, and in contrast to this, the pieces of angle information θ1, θ2 from the angle detection unit 6 continue to change in the fully closed direction, but the pieces of angle information θ1, θ2 do not reach equal to or less than an abnormal voltage threshold in the valve closing direction, so the CPU 11 can not detect an abnormal state (i.e., disconnection or open circuit of the power line L3).

Therefore, in the above-mentioned interval from the time point h (i.e., the occurrence of disconnection of the power line L3) to the time point i, the CPU 11 continues to carry out the 100% supply of electric power in the valve opening driving direction based on the pieces of angle information θ1, θ2, so the actual throttle angle θr is rapidly driven to the open side.

As a result, the vehicle speed Vs begins to rise up in a rapid manner from the time point i which is slightly later than the time point h.

Hereinafter, when the pieces of angle information θ1, θ2 reach equal to or less than the abnormal voltage threshold in the valve closing direction at the time point i, the CPU 11 detects the abnormality of the pieces of angle information θ1, θ2 (disconnection or open circuit of the power line L3), and after the detection of the abnormality (time point i), the actual throttle angle θr becomes unknown, so the supply of electric power from the control unit 1 to the motor 2 is made into 0%.

In addition, the actual throttle angle θr after the time point i is induced or guided to the intermediate degree of opening θM by means of the induction mechanism 5, so the vehicle speed Vs decreases in a rapid manner from a time point m which is slightly later than the time point i. In particular, in a vehicle of light weight such as an automatic two-wheeled vehicle, the rapidly decreasing tendency of the vehicle speed Vs becomes strong, thus giving a large deceleration shock to the driver.

On the other hand, according to the second embodiment of the present invention shown in FIG. 8, it becomes possible to suppress the deceleration shock as shown in FIG. 7.

In FIG. 8, similarly as stated above (FIG. 7), the pieces of angle information θ1, θ2, the valve driving direction of the motor 2, the electric power supplied from the control unit 1 to the motor 2, and the vehicle speed Vs in cases where a break or disconnection has occurred in the power line L3 at the time point h are illustrated in a time series manner.

In FIG. 8, in the normal interval from the time point g to the time point h, similarly as stated above, the target opening θo from the CPU 11, the pieces of angle information θ1, θ2, and the actual throttle angle θr are coincident with one another, and hence the vehicle speed Vs is constant.

However, as in the case of the above-mentioned first embodiment (FIG. 4), the CPU 11 serves to store, in the above-mentioned normal interval from the time point g to the time point h, the target opening θo from the CPU 11, the pieces of angle information θ1, θ2, the valve driving direction of the motor 2, and the value of electric power supplied from the control unit 1 to the motor 2, into the memory 13 in a time series manner, in preparation for the case where the power line L3 is disconnected.

When the power line L3 is disconnected at the time point h, the pieces of angle information θ1, θ2 changes in the fully closed direction (0 [V]) in the interval from the time point h to the time point i, but does not reach equal to or less than the abnormal voltage threshold in the valve closing direction, so the CPU 11 is not able to detect the abnormality and carries out feedback control of the motor 2 in the valve opening direction with the 100% amount of power supply.

As a result of this, at the time point h, the actual throttle angle θr is driven to the open side in a rapid manner, so the vehicle speed Vs begins to rise up from the time point i which is slightly later than the time point h.

On the other hand, when the pieces of angle information θ1, θ2 reach equal to or less than the abnormal voltage threshold in the valve closing direction at the time point i, the CPU 11 detects the abnormality of the pieces of angle information θ1, θ2, and estimates an actual throttle angle θr(i) at the time point i according to the following equation (3).

$$\theta r(i)=\theta h-\Delta\theta OP'\times Thi \quad (3)$$

Here, note that in equation (3) above, θh is the pieces of angle information (θ1, θ2) at the time point h, Thi is a period of time from the time point h to the time point i, and ΔθOP' is an amount of change at the open side per unit time of the pieces of angle information θ1, θ2 at the time of the 100% supply of electric power (the rate of change in the opening direction).

The period of time Thi from the time point h to the time point i can be uniquely calculated with the use of the resistance values of the internal variable resistances r1, r2 inside the angle detection unit 6, and the resistance values of the input resistors R1, R2 inside the control unit 1.

In addition, the piece of angle information θh at the time point h can be calculated with the use of the pieces of angle information θ1, θ2 stored in the memory 13 inside the control unit 1 in a time series manner, and the period of time Thi from the time point h to the time point i.

FIG. 9 is an explanatory view which shows the amount of change ΔθOP' at the open side per unit time of the pieces of angle information θ1, θ2 at the time of the 100% supply of electric power.

As shown in FIG. 9, the amount of change ΔθOP' at the open side can be experimentally obtained based on the relation between the piece of angle information θh at the time point h and the intermediate degree of opening θM, by taking into consideration of the influence of the induction mechanism 5 which serves to induce or guide the electronic throttle valve 3 to the intermediate degree of opening θM.

Then, returning to FIG. 8, the CPU 11 estimates the actual throttle angle θr(i) at the time point i from the equation (3), and performs control for making the throttle angle θr(i) (estimated value) at the time point i coincident with the piece of angle information θh at the time point h (the degree of opening at the time of normal operation before the occurrence of abnormality).

That is, at the time point i, the CPU 11 changes the valve driving direction to the valve closing direction while ignoring the pieces of angle information θ1, θ2, and at the same time calculates an electric power supply time TCL to the motor 2 for driving the electronic throttle valve 3 with the 100% amount of power supply, according to the following equation (4).

$$TCL=\{\theta h-\theta r(i)\}/\Delta\theta CL' \quad (4)$$

Here, note that in equation (4) above, ΔθCL' is an amount of change at the closed side per unit time of the pieces of angle information θ1, θ2 at the time of the 100% supply of electric power (the rate of change in the closing direction), and is represented as shown in FIG. 10.

As shown in FIG. 10, the amount of change ΔθCL' at the closed side can be experimentally obtained based on the relation between the actual throttle angle θr(i) at the time point i and the intermediate degree of opening θM, in consideration of the influence of the induction mechanism 5.

According to this, the control unit 1 can return the actual throttle angle θr to the piece of angle information θh at the time point h in a quick manner by energizing the motor 2 with the 100% amount of power supply in the valve closing driving direction over the electric power supply time TCL from the time point i to time point j.

As a result, an abrupt rise of the vehicle speed Vs is suppressed, and at the time point j, the vehicle speed Vs returns to the speed at the time of normal operation (at the time point h).

Here, note that in the interval from the time point h to the time point i, the actual throttle angle θr changes between the target opening θo and the actual throttle angle θr(i) at the time point i, but if the period of time of the change at this time is a short time, as shown in FIG. 8, a rise in the vehicle speed Vs will hardly be generated.

Subsequently, in an interval from the time point j to time point k, in order to make the vehicle travel at a safe speed, the CPU 11 drives the motor 2 in such a manner that the actual throttle angle θr goes to the intermediate degree of opening θM gradually at a constant rate, so as not to cause a rapid change of the actual throttle angle θr.

At this time, the amount of power supply to the motor 2 at the time point j uses the value of electric power supplied to the motor 2 (the amount of power supply before the occurrence of abnormality) stored in the memory 13 inside the control unit 1 in a time series manner, and is made to decrease at a constant rate from the time point j to the time point k.

As a result of this, the actual throttle angle θr can be driven to the intermediate degree of opening θM in such a manner as not to cause a rapid change.

As described above, the electronic throttle control apparatus according to the second embodiment (FIG. 1, FIG. 2, and FIG. 8 through FIG. 10) of the present invention is provided, similar to the above-mentioned first embodiment, with the motor 2 that drives the electronic throttle valve 3, the angle detection unit 6 that detects the angle of the electronic throttle valve 3, the electric power supply unit (the motor drive circuit 12, the electric power supply wires L1, L2) that supplies electric power to the motor 2, and the control unit 1 that generates an electric power supply command to the motor 2 based on the pieces of angle information θ1, θ2 detected by the angle detection unit 6.

In this case, the control unit 1 generates, after the detection of the abnormality of the angle detection unit 6 (the brake or disconnection of the power line L3), the electric power supply command to the motor 2 based on the piece of angle information (θh) before the detection of the abnormality of the angle detection unit 6 (at the time point h).

Specifically, the control unit 1 estimates, after the detection of the abnormality of the angle detection unit 6, the actual throttle angle (θr(i)) immediately after the detection of the abnormality of the angle detection unit 6 (at the time point i) from the piece of angle information (θh) before the detection of the abnormality of the angle detection unit 6 (at the time point h), and generates the electric power supply command to the motor 2 so that the actual throttle angle θr of the electronic throttle valve 3 is coincident with the piece of angle information (θh) before the occurrence of the abnormality of the angle detection unit 6.

In addition, after the detection of the abnormality of the angle detection unit 6, the control unit 1 performs the supply of electric power to the motor 2 by means of the combination of a plurality of control operations, so that the actual throttle angle θr of the electronic throttle valve 3 is controlled to the intermediate degree of opening θM.

Specifically, the plurality of control operations include an operation which makes the actual throttle angle θr(i) (the estimated value) of the electronic throttle valve 3 coincident with the piece of angle information (θh) before the occurrence of the abnormality, by performing the 100% amount of power supply to the motor 2 after the detection of the abnormality of the angle detection unit 6, and an operation which makes the actual throttle angle θr of the electronic throttle valve 3 move to the intermediate degree of opening θM, by returning, after the actual throttle angle θr becomes coincident with the piece of angle information (θh) before the occurrence of the abnormality, the amount of electric power supplied to the motor 2 to the amount of power supply before the occurrence of the abnormality, and making it decrease at a fixed rate.

Further, in the operation which makes, after the detection of the abnormality of the angle detection unit 6, the actual throttle angle 6 θr of the electronic throttle valve 3 coincident with the piece of angle information θh before the occurrence of the abnormality, the control unit 1 prohibits the use of the pieces of angle information θ1, θ2 after the detection of the abnormality, and controls the motor 2 based on the piece of angle information θh before the angle detection unit 6 becomes abnormal, the information of electric power supplied to the motor 2 during feedback control before the angle detection unit 6 becomes abnormal, the period of time (Thi) until the abnormality of the angle detection unit 6 is detected, and the rates of change (ΔθOF, ΔθCL') of the throttle angle which have been preset before the angle detection unit 6 becomes abnormal.

As a result of this, even at the time of the occurrence of the disconnection abnormality of the power line L3, similar to the case of the above-mentioned first embodiment, it is possible to provide safe travel to the driver without causing rapid acceleration or rapid deceleration, while not spoiling the controllability of the electronic throttle valve 3.

What is claimed is:

1. An electronic throttle control apparatus comprising:

a motor that drives an electronic throttle valve for adjusting an amount of intake air in an internal combustion engine;

an angle detection unit that detects an angle information of said electronic throttle valve;

an electric power supply unit that supplies electric power to said motor; and a control unit configured to generate an electric power supply command to said motor based on the angle information, and control a supply of the electric power to said motor by said electric power supply unit;

wherein, when an occurrence of an abnormality of the angle detection unit is detected at a first time point, a throttle valve driving direction is changed from an opening direction to a closing direction, and said control unit is further configured to generate the electric power supply command to said motor and to control, at a second time point subsequent to the first time point, changing a closing angle of the electronic throttle valve, which is a throttle angle in the closing direction immediately after the occurrence of the abnormality, to an actual throttle angle coincident with a last opening throttle angle in an opening direction immediately prior to the first time point, based on the angle information detected before the occurrence of the abnormality.

2. The electronic throttle control apparatus as set forth in claim 1, wherein said control unit is configured to estimate the closing angle from the angle information detected before the occurrence of the abnormality.

3. The electronic throttle control apparatus as set forth in claim 1, wherein, in generating the electric power supply command to the motor and controlling the changing of the closing angle of the electronic throttle valve at the second time point, said control unit is configured to control the supply of the electric power to said motor by performing a combination of a plurality of control operations, so that the actual throttle angle is controlled to a predetermined intermediate degree of opening.

4. The electronic throttle control apparatus as set forth in claim 3, wherein said plurality of control operations include:

a first operation which makes the actual throttle angle to become coincident with the last opening throttle angle in the opening direction before the occurrence of the abnormality, by performing a 100% amount of the electric power to said motor for a first time period, and a second operation which makes the actual throttle angle move to said intermediate degree of opening, after said actual throttle angle is made coincident with said last opening throttle angle, by changing an amount of the electric power supplied to said motor during the first time period to an amount of the electric power supplied before the occurrence of the abnormality, and decreasing the supply of the electric power at a fixed rate.

5. The electronic throttle control apparatus as set forth in claim 4, wherein:

in the first operation, said control unit is configured to inhibit the use of the angle information after the detection of the abnormality, and to control said motor based on the angle information before said angle detection unit becomes abnormal, information of the electric power supplied to said motor before said angle detection unit becomes abnormal, a period of time until the abnormality of said angle detection unit has been detected, and a rate of change of the throttle angle in the closing direction which has been preset before said angle detection unit becomes abnormal.

6. The electronic throttle control apparatus as set forth in claim 1, wherein the control unit is configured to generate the electric power supply command to the motor to move the actual throttle angle to an intermediate degree of opening, in response to the actual throttle angle becoming coincident with the last opening throttle angle in the opening direction before the occurrence of the abnormality.

7. The electronic throttle control apparatus as set forth in claim 6, wherein the control unit is configured to supply a 100% amount of the electric power to the motor for a first time period to make the actual throttle angle coincident with the last opening throttle angle in the opening direction before the occurrence of the abnormality, and to decrease the supply of the electric power to make the actual throttle angle move to the intermediate degree of opening.

* * * * *